US005252153A

United States Patent [19]

Ochi et al.

[11] Patent Number: 5,252,153

[45] Date of Patent: Oct. 12, 1993

[54] PROCESS FOR PRODUCING STEEL BAR WIRE ROD FOR COLD WORKING

[75] Inventors: Tatsuro Ochi; Yoshiro Koyasu, both of Muroran; Yukio Noguchi, Futtsu, all of Japan

[73] Assignee: Nippon Steel Corporation, Tokyo, Japan

[21] Appl. No.: 896,187

[22] Filed: Jun. 10, 1992

[30] Foreign Application Priority Data

Jun. 14, 1991 [JP] Japan ..... 3-143600

[51] Int. Cl.[5] ..... C21D 8/06

[52] U.S. Cl. ..... 148/598

[58] Field of Search ..... 148/598, 599

[56] References Cited

U.S. PATENT DOCUMENTS 3,711,338 1/1973 Vitelli ..... 148/598

3,926,687 12/1975 Gondo et al. ..... 148/598

FOREIGN PATENT DOCUMENTS 41-19283 11/1966 Japan .

48111 11/1981 U.S.S.R. ..... 148/598

*Primary Examiner*—Deborah Yee

*Attorney, Agent, or Firm*—Kenyon & Kenyon

[57] ABSTRACT

A steel comprising 0.1 to 1.5% of C and 0.25 to 2.0% of Mn is heated to 900° to 1250° C., and the heated steel is hot-rolled at a temperature in the range of from $Ar_3$ to $(Ar_3+200)$° C. or Arcm to (Arcm+200)° C. with a total reduction of area of 30% or more. The hot-rolled material is cooled to complete a ferrite/pearlite transformation or a pro-eutectoid cementite/pearlite transformation. The transformed material is subjected to finish hot rolling at a temperature in the range of from $(Ac_1-400)$ to $Ac_1$° C. with a total reduction ratio of 10 to 70%. If necessary, the material after the finish hot rolling is cooled to 300° C. at an average cooling rate of 1° C./sec or less. A spheroidization annealing of the steel bar wire rod produced according to the process of the present invention enables a good spheroidized texture to be formed.

16 Claims, No Drawings

PROCESS FOR PRODUCING STEEL BAR WIRE ROD FOR COLD WORKING

BACKGROUND OF THE INVENTION

1. Field of the Invention

The present invention relates to a process for producing a steel bar wire rod for cold working. More particularly, the present invention is concerned with a process for producing a soft steel bar wire rod for cold working that can improve the softening level after spheroidization annealing to facilitate the subsequent cold working such as cutting, cold forging and machining in the production of various bolt parts, automobile parts, construction machine parts, bearing parts, etc.

2. Description of the Related Art

The majority of various bolt parts, automobile parts, construction machine parts, bearing parts, etc. has hitherto been produced by subjecting a steel bar wire rod to cold forming such as cutting, cold forging or machining. In cold forming, the rolled material is usually so hard that it is difficult to perform cold working. For this reason, spheroidization annealing is conducted prior to cold forming for the purpose of improving the cold workability. At the present time, however, the softening level is not satisfactory, so that, for example, in the case of cold forging, a further softening of the steel material is desired in the art for the purpose of further improving the tool life.

On the other hand, Japanese Examined Patent Publication (Kokoku) No. 41-19283 discloses a method of preliminarily treating a steel for spheroidization annealing characterized in that a steel bar wire rod is subjected to working of 30% or more at a temperature of from 200° C. to the recrystallization temperature (this temperature is 400° C. in the Example). Although according to this method, the spheroidizing of carbide is accelerated by the spheroidization annealing, and the intervals of carbide particles become so small that it is difficult to attain satisfactory softening. For this reason, at the present time, this technique is not always used in the art.

Accordingly, an object of the present invention is to provide a process for producing a soft steel bar wire rod for cold working that can realize an excellent softening level through conventional spheroidization annealing.

SUMMARY OF THE INVENTION

The present inventors have made extensive and intensive studies with a view to realizing an excellent softening level through conventional spheroidization annealing and, as a result, have found the following facts.

In order to realize an excellent softening level through conventional spheroidization annealing, it is important to satisfy the following two requirements.

(1) Undissolved cementite particles (spheroidal carbide) produced from a plate cementite constituting a pearlite structure are allowed to remain at large intervals in a suitable amount, preferably in an amount of from about $2\times10^5$ to $6\times10^5$ particles/mm$^2$ at the holding for spheroidization annealing.

(2) Austenite particles are coarsened to 20 μm or less at the holding for spheroidization annealing.

The following means are useful for satisfying the above-described requirement (1).

① Hot rolling is conducted at a temperature just above the $Ar_3$ point or just above Arcm with a total reduction of area of 30% or more to form a pearlite having large lamellar intervals at the time of completion of the transformation.

② Thereafter, hot rolling is conducted at a temperature of from ($Ac_1-400$) to $Ac_1$° C. with a total reduction of area of 10 to 70% to divide the plate cementite into sections and agglomerate the section.

③ Further, when the material after finish hot rolling is cooled to 300° C. at an average cooling rate of 1° C./sec or less, it becomes easy for undissolved cementite particles to remain in a suitable amount at large intervals at the holding for spheroidization annealing.

In order to satisfy the above-described requirement (2), it is necessary to conduct hot rolling at a temperature just above the $Ar_3$ point or just above the Arcm with a total reduction of area of 30% or more.

The present invention has been made based on the above-described novel finding, and the subject matter of the present invention resides in a process for producing a steel bar wire rod for cold working, comprising heating a steel comprising, in terms of % by weight (% is hereinafter by weight), 0.1 to 1.5% of C and 0.25 to 2.0% of Mn with the balance consisting of Fe and unavoidable impurities to 900° to 1250° C., hot-rolling the heated steel at a temperature of from $Ar_3$ to ($Ar_3+200$)° C. or Arcm to (Arcm+200)° C. with a total reduction of area of 30% or more, cooling the hot-rolled material to complete a ferrite/pearlite transformation or a proeutectoid cementite/pearlite transformation and subjecting the transformed material to finish hot rolling at a temperature of from ($Ac_1-400$) to $Ac_1$° C. with a total reduction of area of 10 to 70%. If necessary, this process may further comprise the step of subjecting the material after the finish hot rolling to 300° C. at an average cooling rate of 1° C./sec or less.

DESCRIPTION OF THE PREFERRED EMBODIMENTS

The material contemplated in the present invention is a steel composed mainly of 0.1 to 1.5% of C and 0.25 to 2.0% of Mn. The reason for the limitation of the contents of C and Mn will now be described.

In the steel bar wire rod contemplated in the present invention, a steel bar wire rod is produced according to the process of the present invention and subjected to cold working and then hardening and tempering to ensure a predetermined strength and toughness. In this case, when the C content is less than 0.1%, sufficient strength is not obtained while when it exceeds 1.5%, the toughness deteriorates. For this reason, the C content was limited to 0.1 to 1.5%.

Mn is important for ensuring the hardenability and dissolving Mn in the cementite to stabilize the cementite ($(Fe, Mn)_3C$) in austenite for the purpose of allowing undissolved cementite particles to remain in a suitable amount at large intervals at the holding time for spheroidization annealing. When the content is less than 0.25%, the effect is small while when the content exceeds 2%, the effect is saturated. For this reason, the Mn content was limited to 0.25 to 2.0%.

The incorporation of C and Mn is indispensable to the present invention. Besides these elements, if necessary, Si and Al may be incorporated as an deoxidizing element in an amount of from 0.03 to 1.00% and an amount of from 0.015 to 0.05%, respectively, Cr, Mo and Ni may be incorporated in an amount of from 0.01 to 2.0%, an amount of from 0.01 to 1.0% and an amount of from 0.1 to 3.5%, respectively, for the purpose of increasing the hardenability, Nb, V, Ti and N may be incorporated in an amount of from 0.005 to 0.1%, an amount of from 0.03 to 0.3%, an amount of from 0.005 to 0.04% and an amount of from 0.003 to 0.020%, respectively, for the purpose of regulating the particle size, and S may be incorporated in an amount of from 0.01 to 0.15% for the purpose of improving the machinability.

In the present invention, the above-described steel is heated to 900° to 1250° C., hot rolling is conducted at a temperature of from $Ar_3$ to $(Ar_3+200)$° C. or Arcm to (Arcm+200)° C. with a total reduction of area of 30% or more, and a ferrite/pearlite transformation or a proeutectoid cementite/pearlite transformation is then completed. The reason for this will now be described. The reason for this will now be described. The reason for the limitation of the heating temperature to 900° to 1250° C. is that when the heating temperature is below 900° C., the rolling temperature in an austenite region becomes so low that the refinement of the austenite grain by rolling in a recrystallization region is unsatisfactory while when the heating temperature exceeds 1250° C., the austenite crystal grain is significantly coarsened. Then, rolling is conducted at a temperature of from $Ar_3$ to $(Ar_3+200)$° C. or Arcm to (Arcm+200)° C. with a total reduction ratio of 30% or more for the purpose of refining the austenite grain through recrystallization and, at the same time, forming a pearlite having large lamellar intervals and reducing the austenite grain diameter at the holding for spheroidization annealing. When the rolling temperature exceeds $(Ar_3+200)$° C. or (Arcm+200)° C. and the total reduction of area is less than 30%, the intended effect is small while when the rolling temperature is below $Ar_3$ or Arcm, the refinement of the austenite grain through recrystallization is unsatisfactory. For this reason, the rolling should be conducted under conditions of a temperature in the range of from $Ar_3$ to $(Ar_3+200)$° C. or Arcm to (Arcm+200)° C. and a total reduction of area of 30% or more.

In the present invention, the finish hot rolling is conducted at a temperature of from $(Ac_1-400)$ to $Ac_1$° C. with a total reduction of area of 10 to 70%. This is because the plate cementite is divided into sections and agglomerated for the purpose of allowing undissolved cementite particles to remain in a suitable amount at large intervals at the holding for spheroidization annealing. When the rolling temperature exceeds $Ac_1$ and the total reduction ratio is less than 10%, this effect is small while when the rolling temperature is below $(Ac_1-400)$° C. and the total reduction of area exceeds 70%, the work hardening of the ferrite matrix becomes so large that the ferrite matrix cannot be sufficiently softened in the subsequent spheroidization annealing. For this reason, the rolling should be conducted under conditions of a temperature of from $(Ac_1-400)$ to $Ac_1$° C. and a total reduction of area of 10 to 70%.

The spheroidization annealing is conducted under conventional conditions, that is, by holding the material at a temperature of from 700° to 820° C. for 2 to 7 hr and then gradually cooling the heated material to a temperature of from 600° to 720° C. at a cooling rate of 0.1 to 1.0° C./min.

As described in claim 2, in the present invention, if necessary, the material after finish hot rolling may be cooled to 300° C. at an average cooling rate of 1° C./sec or less. This is because Mn is dissolved in the cementite to stabilize the cementite in austenite for the purpose of allowing undissolved cementite particles to remain in a suitable amount at large intervals at the holding for spheroidization annealing and this effect is significant when the average cooling rate is 1° C./sec or less.

The effect of the present invention will now be described in more detail with reference to the following Examples.

EXAMPLE

Chemical ingredients of materials under testing are listed in Table 1.

These materials were produced by a melt process in a converter and continuously cast. They were subjected to blooming to form blooms having a size of 162 mm square and rolled into a round bar steel material having a size of 20 to 50 mm under conditions specified in Table 2. The spheroidization annealing was carried out on these rolled materials under conditions specified in Table 3. The properties of the spheroidized materials are also given in Table 3.

The evaluation of the spheroidized materials was conducted on the basic of two properties, that is, the tensile strength and the degree of spheroidizing specified in JIS G3539, and the target of the quality of the annealed material was set to spheroidizing degree of No. 2 or less corresponding to the standard of the conventional cold forged steel.

As is apparent from Table 3, all the examples of the present invention exhibited a spheroidizing degree of No. 2 or less, and the tensile strength as well is on a lower level. Among the examples of the present invention, level Nos. 9, 10 and 13 are examples wherein the average cooling rate to 300° C. was 1° C./sec. These examples exhibited a further improvement in both the spheroidizing degree and the tensile strength.

On the other hand, level Nos. 2 and 3 are respectively a comparative example wherein the soaking temperature was lower than the temperature range specified in the present invention and a comparative example wherein the soaking temperature was higher than the temperature range specified in the present invention. Level No. 5 is a comparative example wherein the total reduction of area by rolling at a temperature of from $Ar_3$ to $(Ar_3+200)$° C. was lower than the lower limit of the total reduction of area specified in the present invention. Level Nos. 6 and 11 are each a comparative example wherein the total reduction of area by rolling at a temperature in the range of from $(Ac_1400)$ to $Ac_1$° C. was lower than the lower limit of the total reduction of area specified in the present invention. Level Nos. 16, 17 and 18 were each a comparative example wherein the Mn content was lower than the lower limit of the Mn content specified in the present invention. In all of these comparative examples, the spheroidizing degree was No. 3 or more, and the softening degree as well was not satisfactory. Further, level No. 12 is a comparative example wherein the total reduction of area by rolling at a temperature of from $(Ac_1-400)$ to $Ac_1$° C. was higher than the upper limit of the total reduction of area specified in the present invention. In this case, although a good degree of spheroidization can be attained, the softening degree is not satisfactory compared with level No. 10, i.e., an example of the present invention having the same steel material as No. 12.

TABLE 1

| Steel No. | Classif-ication | C | Mn | Si | Cr | AL | Mo | Ni | Nb | V | Ti | N | S |
|---|---|---|---|---|---|---|---|---|---|---|---|---|---|
| A | Present invention | 0.20 | 1.10 | 0.25 | 0.83 | 0.035 | — | — | — | — | — | 0.006 | 0.018 |
| B | Present invention | 0.47 | 0.79 | 0.29 | — | 0.027 | — | — | — | — | — | 0.012 | 0.035 |
| C | Present invention | 0.98 | 0.54 | 0.27 | 1.08 | 0.034 | — | — | — | — | — | 0.009 | 0.021 |
| D | Present invention | 1.39 | 0.85 | 0.31 | 0.57 | 0.043 | — | — | — | — | — | 0.007 | 0.019 |
| E | Present invention | 0.39 | 0.74 | 0.26 | 1.72 | 0.038 | 0.18 | — | — | — | — | 0.008 | 0.027 |
| F | Present invention | 0.33 | 1.65 | 0.21 | — | 0.027 | 0.13 | 2.9 | — | — | — | 0.013 | 0.016 |
| G | Present invention | 0.55 | 0.81 | 0.27 | 0.91 | 0.032 | — | — | — | 0.17 | 0.010 | 0.010 | 0.017 |
| H | Present invention | 0.65 | 0.83 | 0.69 | 1.12 | 0.034 | 0.05 | — | 0.04 | — | — | 0.008 | 0.025 |
| I | Comp. Ex. | 0.53 | 0.20 | 0.27 | — | 0.045 | — | — | — | — | — | 0.009 | 0.023 |
| J | " | 0.18 | 0.22 | 0.29 | 0.12 | 0.028 | 0.01 | — | — | — | — | 0.012 | 0.015 |
| K | " | 1.27 | 0.19 | 0.32 | 0.09 | 0.034 | — | — | — | — | — | 0.008 | 0.017 |

TABLE 2

| Rolling material No. | Classif-ication | Steel No. | Soaking temp. °C. | $Ar_3$ to ($AR_3$ + 200) or Arcm to (Arcm + 200) °C. | Total reduction of area in temp. range described on the left % | ($AC_1$ − 400) to $Ac_1$ °C. | Total reduction of area in temp. range described on the left % | Average rate of cooling to 300° C. °C./sec |
|---|---|---|---|---|---|---|---|---|
| a* | Present invention | A | 1050 | 800 to 1000 | 60 | 330 to 730 | 60 | 1.5 |
| b | Comp. Ex. | A | 850 | " | " | " | 40 | " |
| c | " | A | 1300 | " | " | " | " | " |
| d* | Present invention | B | 1150 | 750 to 950 | 40 | " | " | 1.2 |
| e | Comp. Ex. | B | 1150 | " | 20 | " | " | " |
| f | " | B | 1150 | " | 40 | " | 5 | " |
| g* | Present invention | C | 1100 | 780 to 980 | 50 | 340 to 740 | 20 | " |
| h* | Present invention | D | 1100 | 800 to 1000 | 60 | 320 to 720 | " | " |
| i* | Present invention | E | 1050 | 760 to 960 | 40 | 360 to 760 | 40 | 0.6 |
| j* | Present invention | F | 1050 | 720 to 920 | " | 290 to 690 | " | " |
| k | Comp. Ex. | F | 1050 | " | " | " | 5 | " |
| l | " | F | 1050 | " | " | " | 80 | " |
| m* | Present invention | F | 1050 | " | " | " | 60 | 0.4 |
| n* | Present invention | G | 1050 | 740 to 940 | " | 370 to 770 | 40 | 1.2 |
| o* | Present invention | H | 1100 | " | " | " | " | " |
| p | Comp. Ex. | I | 1050 | 760 to 960 | " | 390 to 790 | " | " |
| q | " | J | 1100 | 820 to 1020 | " | 340 to 740 | " | " |
| r | " | K | 1050 | 790 to 990 | " | 330 to 730 | " | " |

Note) *Example of the present invention

TABLE 3

| Level No. | Classif-ication | Rolling material No. | Spheroidizing conditions: Heating temp. °C. | Gradual cooling termination temp. °C. | Gradual cooling rate °C./min | Quality of annealing material: Tensile strength kgf/mm² | Spheroidizing degree No. |
|---|---|---|---|---|---|---|---|
| 1* | Present invention | a | 770 | 650 | 0.25 | 45.2 | 2 |
| 2 | Comp. Ex. | b | " | " | " | 48.5 | 3 |
| 3 | " | c | " | " | " | 49.3 | 4 |
| 4* | Present invention | d | 750 | 670 | " | 53.1 | 2 |
| 5 | Comp. Ex. | e | " | " | " | 58.2 | 3 |
| 6 | " | f | " | " | " | 60.1 | 3 |
| 7* | Present invention | g | 780 | 690 | " | 66.4 | 2 |
| 8* | Present invention | h | 790 | 680 | " | 83.7 | 2 |
| 9* | Present invention | i | 780 | " | " | 55.9 | 1 |

TABLE 3-continued

| Level No. | Classification | Rolling material No. | Spheroidizing conditions: Heating temp. °C. | Gradual cooling termination temp. °C. | Gradual cooling rate °C./min | Quality of annealing material: Tensile strength kgf/mm² | Spheroidizing degree No. |
|---|---|---|---|---|---|---|---|
| 10* | Present invention | j | 730 | 640 | " | 63.2 | 1 |
| 11 | Comp. Ex. | k | " | " | " | 67.8 | 3 |
| 12 | " | l | " | " | " | 65.4 | 1 |
| 13* | Present invention | m | " | " | " | 62.8 | 1 |
| 14* | Present invention | n | 750 | 670 | " | 60.1 | 2 |
| 15* | Present invention | o | " | " | " | 67.9 | 2 |
| 16 | Comp. Ex. | p | 760 | " | " | 58.4 | 4 |
| 17 | " | q | " | " | " | 49.6 | 4 |
| 18 | " | r | 780 | " | " | 87.4 | 4 |

Note) *Example of the present invention

We claim:

1. A process for producing a steel bar wire rod for cold working, comprising the steps of:

heating a steel having a composition consisting essentially of, in terms of % by weight, 0.1 to 1.5% of C, 0.25 to 2.0% of Mn, 0.03 to 1.00% of Si, 0.015 to 0.05% of Al, 0.003 to 0.020% of N, 0.01 to 0.15% of S, balance Fe and unavoidable impurities to 900° to 1250° C., hot-rolling the heated steel at a temperature of from $Ar_3$ to $(Ar_3+200)$° C. with a total reduction of area of 30% or more, cooling the hot-rolled steel to complete a ferrite/-pearlite transformation or a pro-eutectoid cementite/pearlite transformation, and subjecting the transformed material to finish hot rolling at a temperature in the range of from $(Ac_1-400)$ to $Ac_1$° C. with a total reduction of area of 10 to 70%.

2. A process for producing a steel bar wire rod for cold working, comprising the steps of:

heating a steel having a composition consisting essentially of, in terms of % by weight, 0.1 to 1.5% of C, 0.25 to 2.0% of Mn, 0.03 to 1.00% of Si, 0.015 to 0.05% of Al, 0.003 to 0.020% of N, 0.01 to 0.15% of S, and contains material selected from the group consisting of 0.01 to 2.0% of. Cr, 0.01 to 1.0% of Mo, 0.1 to 3.5% of Ni, 0.005 to 0.1% of Nb, 0.03 to 0.3% of V and 0.005 to 0.04% of Ti, balance Fe and unavoidable impurities to 900° to 1250° C., hot-rolling the heated steel at a temperature of from $Ar_3$ to $(Ar_3+200)$° C. with a total reduction of area of 30% or more, cooling the hot-rolled steel to complete a ferrite/-pearlite transformation or a pro-eutectoid cementite/pearlite transformation, and subjecting the transformed material to finish hot rolling at a temperature in the range of from $(Ac_1-400)$ to $Ac_1$° C. with a total reduction of area of 10 to 70%.

3. A process according to claim 1, wherein a spheroidization annealing is carried out on the finish hot rolling material or the cooling material.

4. A process according to claim 3, wherein a spheroidization annealing is carried out on the finish hot rolling material or the cooling material.

5. A process according to claim 1, further comprising cooling the material after the finish hot rolling to 300° C. at an average cooling rate of 1° C./sec or less.

6. A process for producing a steel bar wire rod for cold working, comprising the steps of:

heating a steel having a composition consisting essentially of, in terms of % by weight, 0.1 to 1.5% of C, 0.25 to 2.0% of Mn, 0.03 to 1.00% of Si, 0.015 to 0.05% of Al, 0.003 to 0.020% of N, 0.01 to 0.15% of S, balance Fe and unavoidable impurities to 900° to 1250° C., hot-rolling the heated steel at a temperature of from Arcm to $(Arcm+200)$° C. with a total reduction of area of 30% or more, cooling the hot-rolled steel to complete a ferrite/-pearlite transformation or a pro-eutectoid cementite/pearlite transformation, and subjecting the transformed material to finish hot rolling at a temperature in the range of from $(Ac_1-400)$ to Ac°C. with a total reduction of area of 10 to 70%.

7. A process for producing a steel bar wire rod for cold working, comprising the steps of:

heating a steel having a composition consisting essentially of, in terms of % by weight, 0.1 to 1.5% of C, 0.25 to 2.0% of Mn, 0.03 to 1.00% of Si, 0.015 to 0.05% of Al, 0.003 to 0.020% of N, 0.01 to 0.15% of S, and contains material selected from the group consisting of 0.01 to 2.0% of Cr, 0.01 to 1.0% of Mo, 0.1 to 3.5% of Ni, 0.005 to 0.1% of Nb, 0.03 to 0.3% of V and 0.005 to 0.04% of Ti, balance Fe and unavoidable impurities to 900° to 1250° C., hot-rolling the heated steel at a temperature of from Arcm to $(Arcm+200)$° C. with a total reduction of area of 30% or more, cooling the hot-rolled steel to complete a ferrite/-pearlite transformation or a pro-eutectoid cementite/pearlite transformation, and subjecting the transformed material to finish hot rolling at a temperature in the range of from $(Ac_1-400)$ to $Ac_1$°C with a total reduction of area of 10 to 70%.

8. A process according to claim 6, further comprising cooling the material after the finish hot rolling to 300° C. at an average cooling rate of 1° C./sec or less.

9. A process according to claim 7, further comprising cooling the material after the finish hot rolling to 300° C. at an average cooling rate of 1° C./sec or less.

10. A process according to claim 6, wherein a spheroidization annealing is carried out on the finish hot rolling material or the cooling material.

11. A process according to claim 7, wherein a spheriodization annealing is carried out on the finish hot rolling material or the cooling material.

12. A process according to claim 8, wherein a spheriodization annealing is carried out on the finish hot rolling material or the cooling material.

13. A process according to claim 9, wherein a spheriodization annealing is carried out on the finish hot rolling material or the cooling material.

14. A process according to claim 2, further comprising cooling the material after the finish hot rolling to 300° C. at an average cooling rate of 1° C./sec or less.

15. A process according to claim 2, wherein a spheriodization annealing is carried out in the finish hot rolling material or the cooling material.

16. A process according to claim 14, wherein a spheriodization annealing is carried out on the finish hot rolling material or the cooling material.

* * * * *

UNITED STATES PATENT AND TRADEMARK OFFICE

CERTIFICATE OF CORRECTION

PATENT NO. : 5,252,153
DATED : October 12, 1993
INVENTOR(S) : Tatsuro OCHI, et al.

It is certified that error appears in the above-indentified patent and that said Letters Patent is hereby corrected as shown below:

Column 3, line 15, delete "The reason for this will now be described."

Column 4, line 24, change "basic" to --basis--.

Column 4, line 51, change "($Ac_1$400)" to --($Ac_1$-400)--.

Column 7, line 63, change "claim 3" to --claim 1--.

Column 9, lines 1, 2, 4, 5, 7, and 8, change "spheriodization" to --spheroidization-- in each line.

Column 10, lines 4, 5, and 8, change "spheriodization" to --spheroidization-- in each line.

Signed and Sealed this
Twenty-first Day of June, 1994

*Attest:*

*Attesting Officer*

BRUCE LEHMAN

*Commissioner of Patents and Trademarks*